US008640584B2

(12) United States Patent
Thievessen et al.

(10) Patent No.: US 8,640,584 B2
(45) Date of Patent: Feb. 4, 2014

(54) DEVICE FOR DECELERATING SHEETS TO BE PLACED ON A STACK, ESPECIALLY PAPER OR CARDBOARD SHEETS

(75) Inventors: Karl Thievessen, Grevenbroich (DE); Dirk Voessing, Willich (DE)

(73) Assignee: Bielomatik Jagenberg GmbH & Co. KG, Neuss (DE)

( * ) Notice: Subject to any disclaimer, the term of this patent is extended or adjusted under 35 U.S.C. 154(b) by 414 days.

(21) Appl. No.: 12/171,681

(22) Filed: Jul. 11, 2008

(65) Prior Publication Data

US 2009/0020945 A1 Jan. 22, 2009

Related U.S. Application Data

(63) Continuation of application No. PCT/EP2006/011632, filed on Dec. 5, 2006.

(30) Foreign Application Priority Data

Jan. 13, 2006 (DE) ..... 10 2006 002 029

(51) Int. Cl.
*B26D 7/06* (2006.01)
*B65H 29/68* (2006.01)

(52) U.S. Cl.
USPC ..... 83/110; 271/182

(58) Field of Classification Search
USPC ..... 83/110, 202, 208, 225, 156, 26, 24, 83/155.1; 428/71, 35.9, 376; 271/182–183
See application file for complete search history.

(56) References Cited

U.S. PATENT DOCUMENTS

| | | | | | |
|---|---|---|---|---|---|
| 3,639,053 | A | * | 2/1972 | Spear, Jr. | 399/385 |
| 3,994,221 | A | * | 11/1976 | Littleton | 101/227 |
| 4,149,484 | A | * | 4/1979 | Koch | 118/42 |
| 4,184,392 | A | * | 1/1980 | Wood | 83/88 |
| 4,221,377 | A | * | 9/1980 | Bodewein et al. | 271/183 |
| 4,429,602 | A | * | 2/1984 | Vits | 83/24 |
| 4,442,174 | A | * | 4/1984 | Neumann et al. | 428/376 |
| 4,713,040 | A | * | 12/1987 | Beigang et al. | 464/132 |
| 4,824,321 | A | * | 4/1989 | van der Donk et al. | 414/757 |
| 4,969,640 | A | * | 11/1990 | Littleton | 271/182 |

(Continued)

FOREIGN PATENT DOCUMENTS

| | | | |
|---|---|---|---|
| DE | 202004005827 | U1 * | 9/2004 |
| EP | 1 016 610 | A2 | 7/2000 |

(Continued)

*Primary Examiner* — Ghassem Alie
*Assistant Examiner* — Bharat C Patel
(74) *Attorney, Agent, or Firm* — Muncy, Geissler, Olds & Lowe, PLLC

(57) ABSTRACT

An apparatus is provided for decelerating sheets which are to be placed on a stack. The apparatus comprises rotatably driven clamping elements, which are provided with clamping zones that intermittently reach to the feeding plane of the sheet when revolving. The apparatus further includes a mating element which is rotationally disposed on the opposite side of the conveying plane of the sheets such that a sheet can be clamped between the clamping zones and the mating element. The clamping elements are connected to an asymmetrical rotary drive unit while being equipped with ring segment-shaped clamping zones on a section of the circumference thereof. A deflecting device is also provided which deflects the rear edges of the sheet from the feeding plane in a downward direction arranged at a distance from and upstream of the clamping elements in the direction of travel of the sheets.

14 Claims, 6 Drawing Sheets

(56) References Cited

U.S. PATENT DOCUMENTS

| | | | | | |
|---|---|---|---|---|---|
| 5,249,790 | A * | 10/1993 | Brame et al. | 271/182 |
| 5,265,861 | A * | 11/1993 | Schaffner et al. | 271/182 |
| 5,415,389 | A * | 5/1995 | Adami | 271/203 |
| 5,417,416 | A * | 5/1995 | Marmin et al. | 271/270 |
| 5,417,558 | A * | 5/1995 | Heindel et al. | 425/145 |
| 5,797,322 | A * | 8/1998 | Lorig et al. | 101/375 |
| 5,992,844 | A * | 11/1999 | Dillinger et al. | 271/182 |
| 6,077,207 | A * | 6/2000 | Yokoyama et al. | 492/30 |
| 6,230,596 | B1 * | 5/2001 | Reinders | 83/27 |
| 6,302,391 | B1 * | 10/2001 | Robert | 271/182 |
| 6,494,452 | B1 * | 12/2002 | Karasiewicz | 271/276 |
| 6,570,354 | B1 * | 5/2003 | Dobbertin et al. | 318/560 |
| 6,659,153 | B1 * | 12/2003 | Kupka | 157/1.24 |
| 7,062,835 | B2 * | 6/2006 | Sugiyama et al. | 29/525 |
| 2002/0190461 | A1 * | 12/2002 | Hagemann et al. | 271/270 |
| 2003/0079584 | A1 * | 5/2003 | Cote et al. | 83/13 |
| 2005/0132910 | A1 * | 6/2005 | Kolbe et al. | 101/153 |
| 2008/0245204 | A1 * | 10/2008 | Voessing | 83/401 |

FOREIGN PATENT DOCUMENTS

| | | | |
|---|---|---|---|
| EP | 1 266 854 | A2 | 12/2002 |
| EP | 1 475 328 | A1 | 11/2004 |
| WO | WO 91/08974 | A1 | 6/1991 |

* cited by examiner

DEVICE FOR DECELERATING SHEETS TO BE PLACED ON A STACK, ESPECIALLY PAPER OR CARDBOARD SHEETS

This nonprovisional application is a continuation of International Application No. PCT/EP2006/011632, which was filed on Dec. 5, 2006, and which claims priority to German Patent Application No. 102006002029.4, which was filed in Germany on Jan. 13, 2006, and which are both herein incorporated by reference.

BACKGROUND OF THE INVENTION

1. Field of the Invention

The present invention relates to a device for decelerating sheets to be placed on a stack, especially paper or cardboard sheets, as well as a machine for sheet cutting material webs that contains a decelerating device for the sheets produced by sheet cutting.

2. Description of the Background Art

In a known manner, sheet cutting machines produce individual sheets from a material web, in particular a paper or cardboard web, by sheet cutting, with the sheets then being placed on stacks. At high operating speeds it is necessary to decelerate the individual sheets, which are transported to the stacking area by conveyor belts, prior to their placement so that no problems arise during stacking.

Known from WO 91/08974, which corresponds to U.S. Pat. No. 5,265,861, is a device of the generic type in which the deceleration device has clamping elements with rotating clamping zones located on both sides of the transport plane of the sheets, wherein the clamping zones of at least one side extend into the infeed plane at least at certain times during rotation, so that a sheet can be clamped between two clamping zones. The clamping elements are driven by a variable rotary drive such that the clamping zones are at the infeed speed of the sheets upon coming into contact therewith. The speed of the clamping zones is then reduced to the desired discharge speed of the sheets. After releasing the clamping of the sheets and before clamping the following sheets, the clamping zones are accelerated to the infeed speed of the sheets again by the variable drive.

The method described in WO 91/08974 has the advantage that it is possible to decelerate the sheets with zero velocity relative to the decelerating elements. This prevents the occurrence of undesired marking on the sheets.

SUMMARY OF THE INVENTION

It is therefore an object of the invention is to create a deceleration device of the generic type that makes it possible to decelerate sheets from high speeds of, e.g., 400 m/min to a considerably lower placement speed of, e.g., 80 m/min in a reliable and non-marking manner so as to form a cascade of overlapping sheets that can then be placed on a stack without problems.

This object is attained according to an embodiment of the invention with the following features: located across the width of the device on at least one side of the transport plane of the sheets are rotatably drivable clamping elements that have clamping zones on a part of their circumference which extend into the infeed plane of the sheets part of the time during rotation; a rotating counter-element is arranged on the opposite side of the transport plane of the sheets such that a sheet can be clamped between the clamping zones and the counter-element; the clamping elements are connected to a variable rotary drive; and located a distance ahead of the clamping elements in the direction of sheet travel is a deflection device by which the trailing edges of the sheets are deflected downward out of the infeed plane.

The spacing of the clamping elements from the deflection device in the direction of sheet travel makes it possible for the clamping zones to engage a sufficient distance from the sheet trailing edge at the start of deceleration so that the deceleration process is completed before the clamping zones are located at the sheet trailing edge. Thus, while the preceding sheet is being decelerated, the following sheet can move forward un-decelerated over its sheet trailing edge, which has been deflected downward. The time during which the following sheet approaches the clamping elements above the preceding sheet is thus additionally available as deceleration time for the preceding sheet. Without this spacing, the deceleration time would be limited to the time during which a following sheet closes the gap to the preceding sheet.

Preferably, clamping elements with rotating clamping zones, also driven by a variable rotary drive, are also located on the other side of the transport plane as the counter-element.

The device for deflecting the sheet trailing edges downward is preferably a periodically switched suction box that has vacuum openings on the top; located beneath the infeed plane of the sheets, it applies suction to the sheet trailing edges, thus moving them downward. In addition, during deceleration of a sheet, the suction box holds back the free end of the sheet between the clamping zones and the sheet trailing edges, thereby keeping it taut. Otherwise, the free end of the sheet would tend to push forward against the decelerating clamping zones.

A three-phase synchronous servo motor that has a very low dynamic moment of inertia is preferably used as the variable drive for the clamping elements and the counter-element. To this end, the motor is relatively long and has a relatively small diameter. Preferably, its ratio of length to diameter is greater than 4.

The clamping zones can include elements in the shape of annular segments that are fastened onto a hollow shaft driven by the variable rotary drive. So that the hollow shaft has a low moment of inertia but still has high torsional stiffness, it is preferably implemented as a carbon-fiber-reinforced plastic tube with an outer diameter of at least 100 mm. As clamping zones, annular segments with an outer diameter in the shape of a circular arc and an outer circumferential length of 40 mm-100 mm are preferably attached to the hollow shaft as clamping zones. The segments are preferably made of a volume-compressible foamed plastic material so that the sheets can be clamped in a slip-free manner while avoiding marking.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
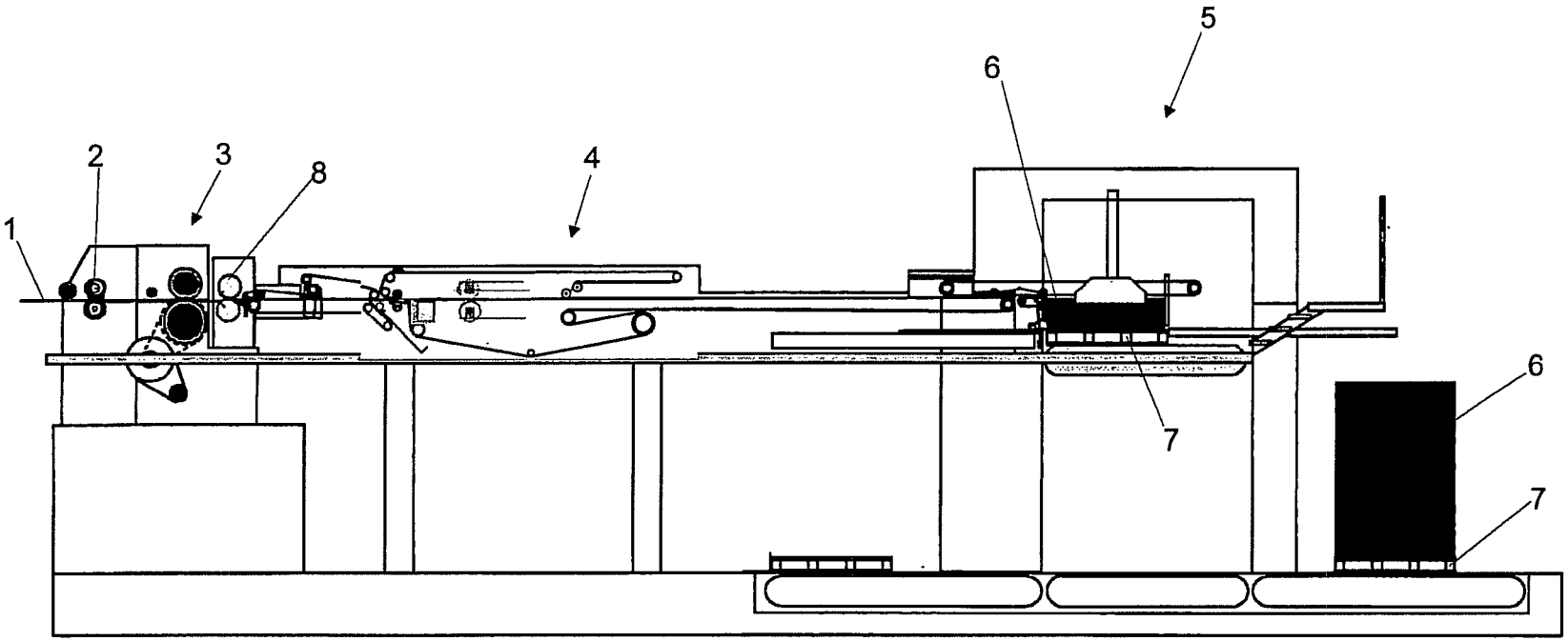
FIG. 1 is a side view of a sheet cutting machine.

The device shown in an overall view in FIG. 1 is used to produce sheets of paper or cardboard from a continuously fed web 1. The following components are arranged one after the other in the direction of web/sheet travel (from left to right in the figures): A slitting device 2 in which the edges of the web are trimmed and, if applicable, the web 1 is divided into as many as six individual webs, a sheet cutting device 3, a deceleration and overlapping device 4 that takes the sheets produced by sheet cutting and decelerates them, wherein a cascade is formed, and a stacker 5 in which the sheets are placed on stacks 6 located on palettes 7.

The sheet cutting device 3 contains, in a known manner, two cutter drums 8 located one above the other, each of which is equipped with at least one cross cutting knife by which the web 1 is divided into sheets 9 as it passes through. If multiple webs 1 lying one over the other are processed, sheet cutting produces sets of sheets that are then transported further. The term "sheet" used hereinafter thus also encompasses sets of sheets that are produced and processed in multilayer operation. Located after the sheet cutting device 3 are elements to accept the web leading edge produced by sheet cutting and to tension the web during sheet cutting, elements for accelerated further transport of the sheet produced by sheet cutting in order to create a gap between two sheets, and the that are delivered to the stacker 5 at reduced transport speed.

It starts with a rapidly rotating upper conveyor belt 10 and an associated lower fast conveyor belt 11, each of which is made up of individual parallel belts and is driven at a speed that is higher than the speed of the web 1 entering the sheet cutting device. In this way, a sheet 9 produced during sheet cutting is transported further at a higher speed, and a gap arises between each pair of successive sheets or sheet sets.

The decelerating and overlapping device 4 begins after the lower fast conveyor belt 11 with a suction box 13 that can be subjected to partial vacuum and whose upper wall, provided with suction openings, extends parallel to and a short distance below the conveying plane of the sheets 9. The suction openings of the suction box 13 can be opened in a pulsed manner, so that the partial vacuum can apply suction to the trailing edge of each sheet 9, deflecting it downward. In this process, the trailing edges of the sheets 9 come away from the rapidly rotating upper conveyor belt 10, which extends over the length of the decelerating and overlapping device 4. The suction box 13 thus acts as a deflection device by means of which the sheet trailing edges are deflected downward out of the infeed plane. A lower conveyor belt 14, which runs at the reduced placement speed with which the sheets are placed on the stack 6, begins at the suction box 13. As a sheet 9 is decelerated, the leading edge of the following sheet, which is still moving faster, slides over its trailing edge. A cascade of overlapping sheets is thus created and is conveyed onward at the slower placement speed on the lower conveyor belt 14.

In order to be able to reliably decelerate the sheets from a high infeed speed of, e.g., 400 m/min to an adequately low placement speed of, e.g., 80 m/min, without canting, and without marking, a deceleration device, containing rotatably drivable clamping elements 16 with clamping zones 17 by which the sheets 9 are clamped and decelerated, is located a distance behind the suction box 13 by which the sheet trailing edges are deflected downward. The clamping elements 16 with the clamping zones 17 are arranged over the width of the device on one side of the transport plane of the sheets (above the transport plane in the present example) in such a manner that the clamping zones 17 extend into the infeed plane of the sheets 9 at certain times during rotation. A rotating counter-element 18 is arranged on the opposite side of the transport plane of the sheets 9 so that a sheet 9 or a set of sheets can be clamped between the clamping zones 17 and the counter-element 18. The clamping elements 16 are located at a distance of at least 100 mm from the beginning of the deflection device (here, the suction box 13) on the infeed side, so that they can engage a sheet 9 at a minimum distance of 100 mm from the sheet trailing edge. In this way, a following sheet has time for its leading edge to slide over the preceding sheet that is being decelerated, before itself being decelerated. If necessary, the clamping elements 16 and the associated counter-element 18 are movable to a limited extent in and opposite to the direction of sheet travel (arrow 19 in FIG. 2), so that the distance to the deflection device (suction box 13) can be set as a function of the format. In this way, the engagement position of the clamping zones 17 on the sheets 9 can be matched to the sheet length.

The clamping elements 16 with the clamping zones 17, like the rotating counter-element 18, are each connected to a variable rotary drive that makes it possible to change the rotational speed during a rotation. The clamping zones 17 are preferably composed of elements in the shape of annular segments attached to the outside of a hollow shaft driven by the variable rotary drive. So that the hollow shaft has a low moment of inertia but still has high torsional stiffness, it is preferably implemented as a carbon-fiber-reinforced plastic tube with an outer diameter of at least 100 mm. The annular segments attached to the hollow shaft as clamping zones 17 preferably have an outer diameter in the shape of a circular arc with an outer circumferential length of 40 mm-100 mm. The circumferential angle of the clamping zones 17 on the hollow shaft is preferably between 50° and 90°. It corresponds to the deceleration angle shown in FIG. 7. The annular segments are preferably made of a volume-compressible foamed plastic material so that the sheets can be clamped in a slip-free manner while avoiding marking. The radially measured thickness of a clamping zone 17 is preferably between 10 mm and 30 mm.

In the example embodiment, the counter-element 18 is also embodied as a rotatable hollow shaft whose circumferential surface is likewise covered with a volume-compressible coating to avoid marking. Alternatively, it is possible to provide the counter-element 18 with clamping zones in the shape of annular segments in a manner identical to the upper clamping element 16. This design offers the option of changing the effective clamping length by a phase shift between the rotary motion of the upper clamping zones 17 and the lower clamping zones of the counter-element.

Figure 7:
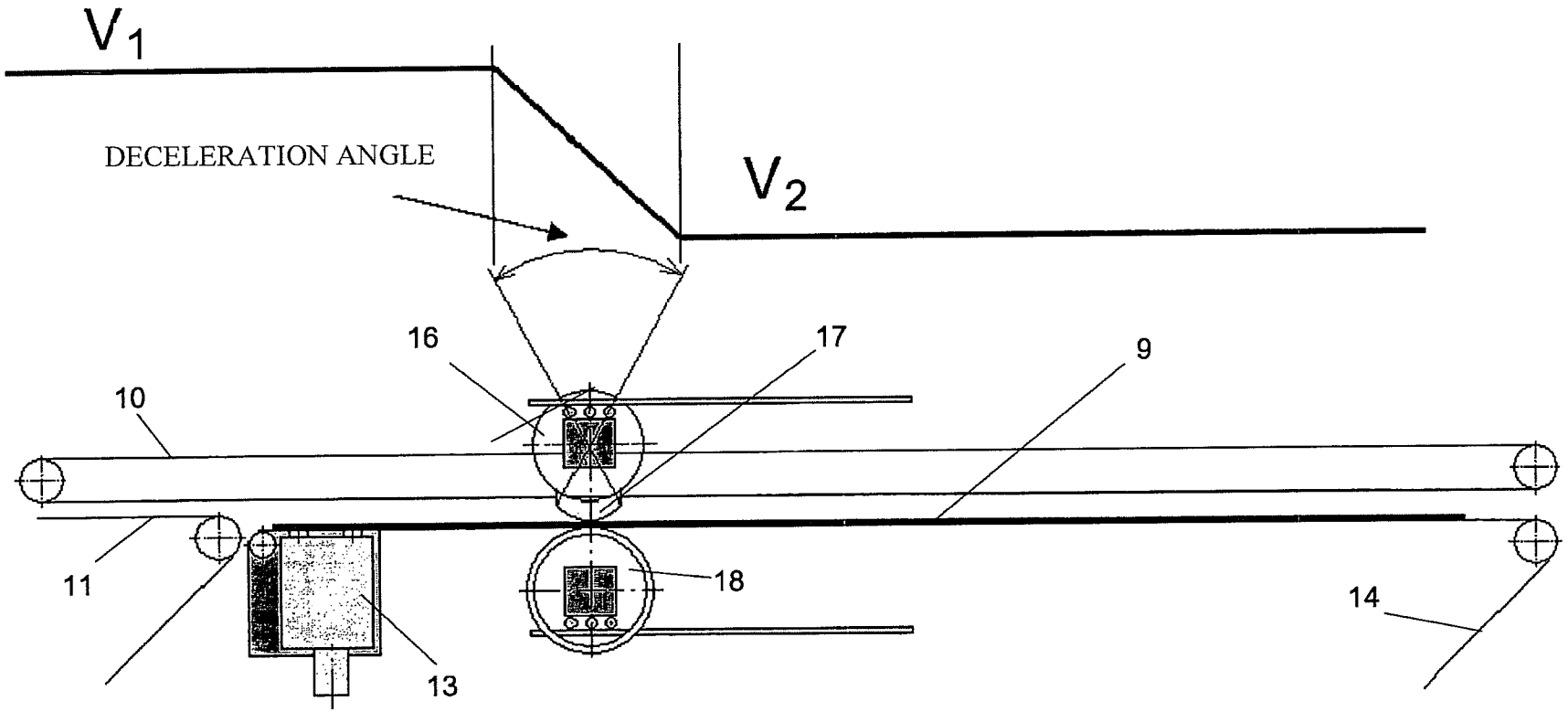
FIG. 7 illustrates a principle of operation of the deceleration device in a side view.
Figure 8:
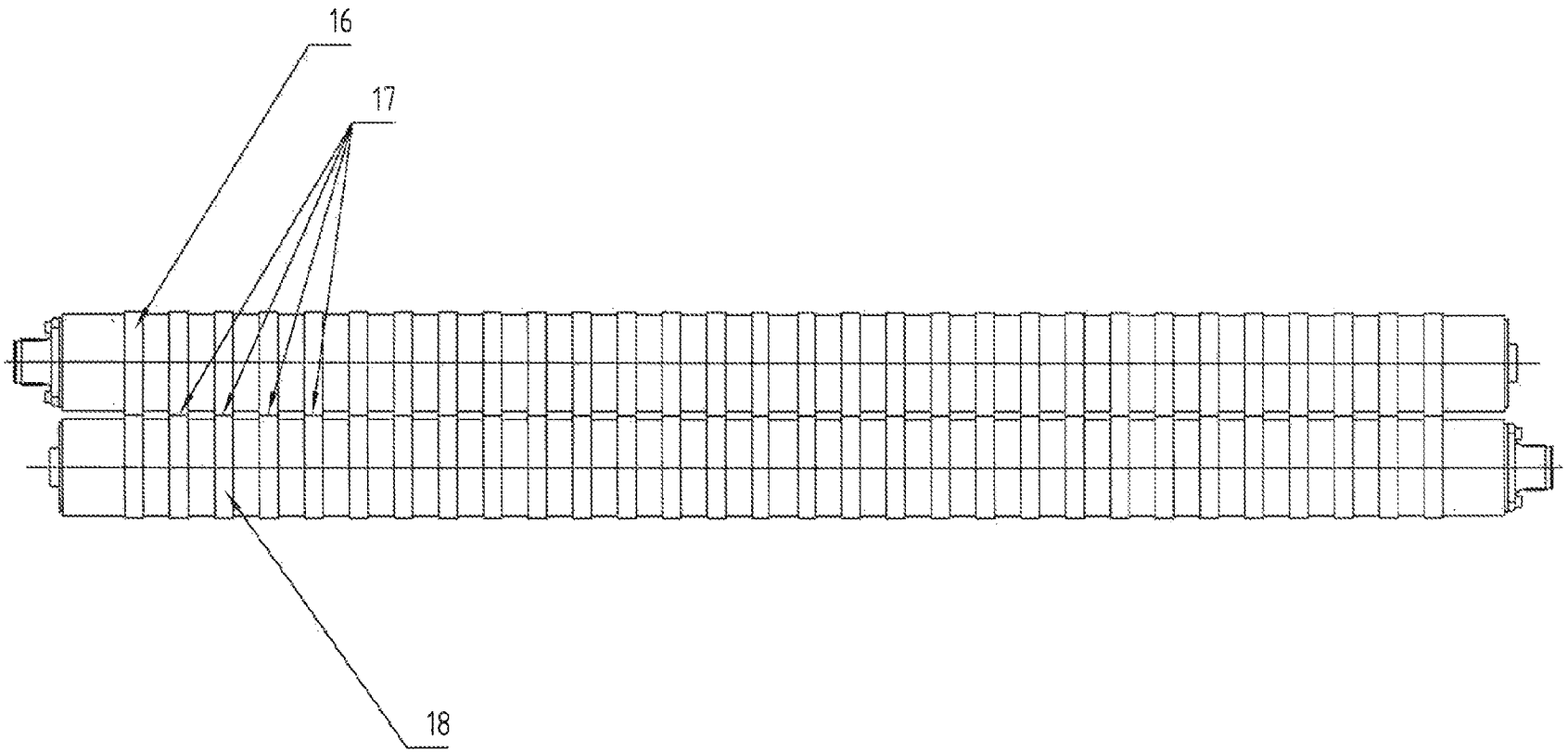
FIG. 8 illustrates rotatably drivable clamping elements.

A three-phase synchronous servo motor that has a very low dynamic moment of inertia is preferably used as the variable drive for the clamping elements 16 and the counter-element 18. To this end, the motor is relatively long and has a relatively small diameter. Preferably, its ratio of length to diameter is greater than 4. FIG. 7 shows the principle of operation of the deceleration device 4.

A sheet 9 or a set of sheets is compressed by the clamping zones 17 and is clamped together with the counter-element 18. The clamping zones 17 are at the higher infeed speed V1 of the sheets upon coming into contact with a sheet. The rotational speed of the clamping zones 7 is then reduced by the variable rotary drive until the lower discharge speed V2 is reached. The deceleration here is slip-free and takes place along a ramp so that compressive stresses alone, and not pushing stresses, arise in a set of sheets. These compressive stresses cause no marking.

The sequence of a deceleration process and the overlapping of sheets 9 is shown in FIGS. 2 through 6.

Figure 2:
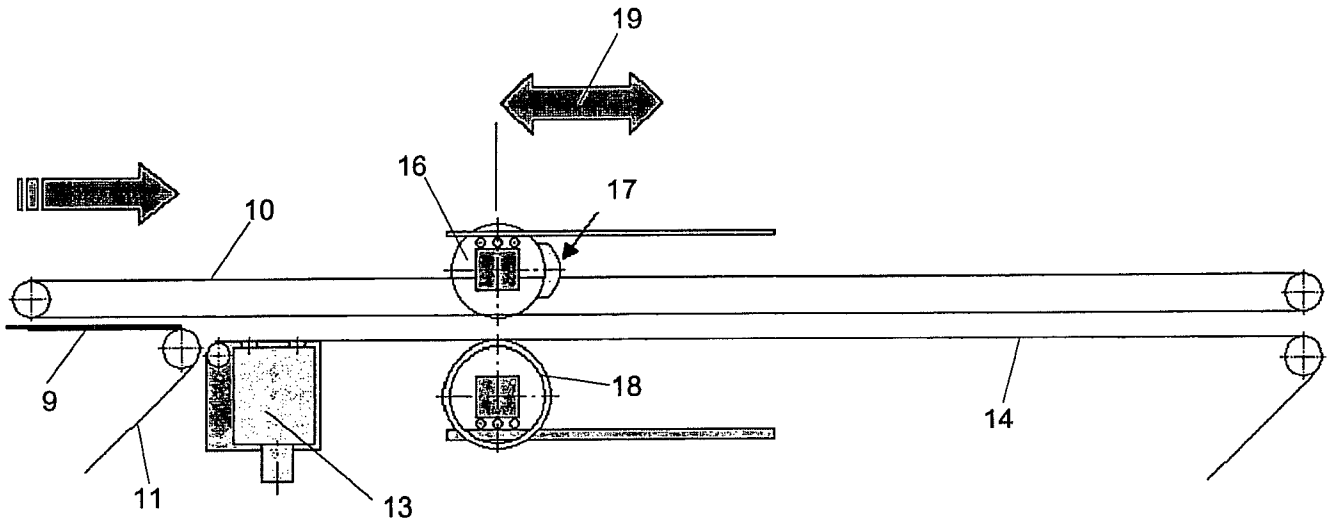
FIGS. 2-6 illustrate a method of operation of the deceleration device in decelerating the sheets according to an embodiment.
Figure 3:
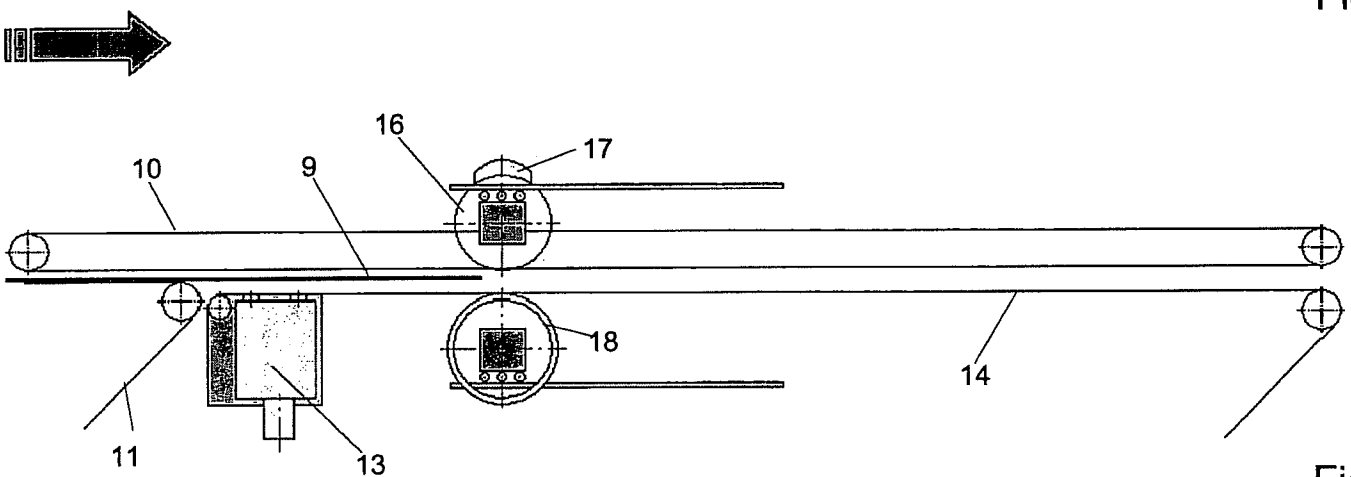
Figure 4:
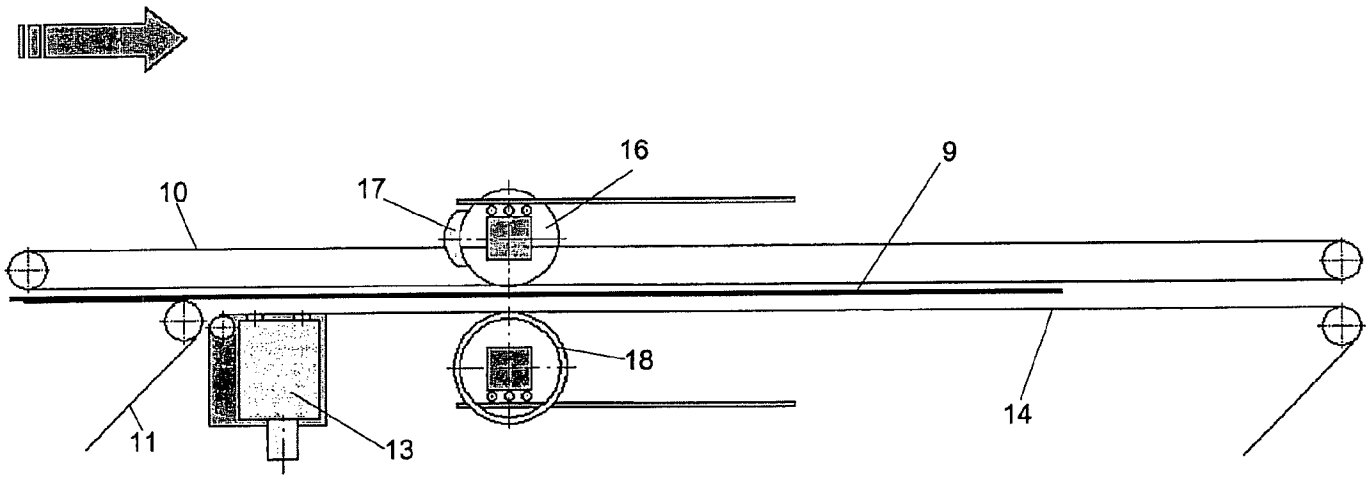
Figure 5:
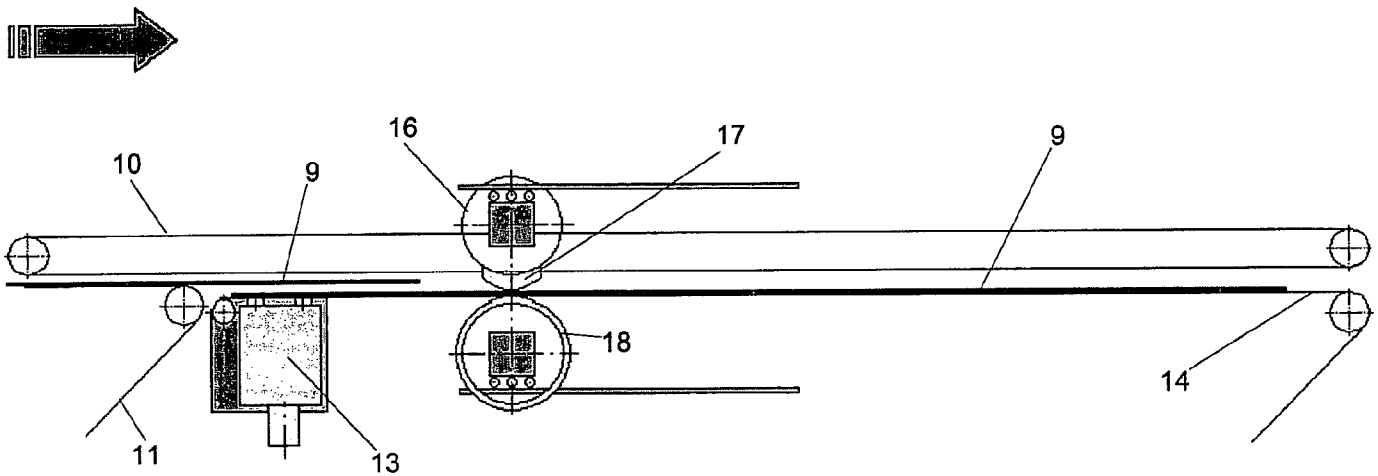
Figure 6:
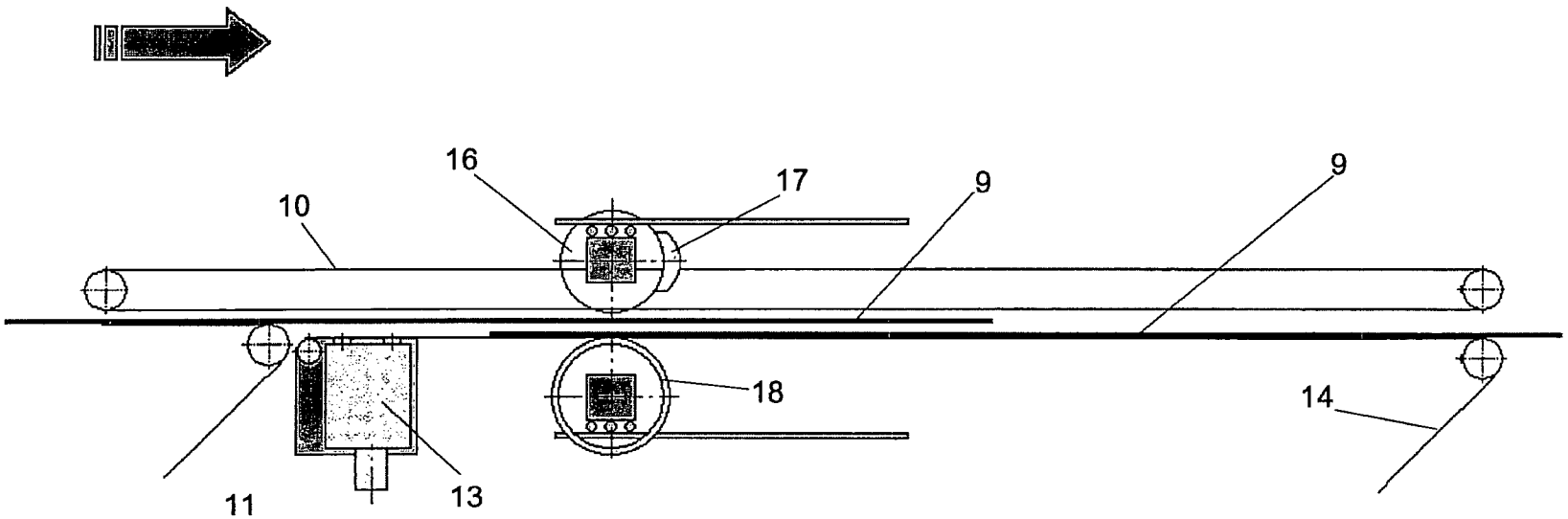

The leading edge of a sheet transported at the high infeed speed by belts 10, 11 enters the deceleration and overlapping device 4 (FIG. 2, FIG. 3). As soon as the trailing edge of the sheet 9 is located above the suction box 13, the suction box is switched on, applying suction to the sheet trailing edge. The latter then comes away from the fast upper belts 10 and rests against the slower lower belts 14. At this moment, the clamping zones 17 come into contact with the sheet 9 and press it down against the counter-element 18, so that a sheet or set of sheets is clamped. At clamping, both the clamping zones 17 and the counter-element 18 have a rotational speed that matches the high infeed speed V1. Next, while the sheets 9 are clamped (FIG. 5), the rotary drive reduces the rotational speed to the lower discharge speed V2. Since the distance of the clamping elements 17, 18 from the sheet trailing edge is more than 100 mm when clamping starts, a following sheet 9 has time for its leading edge to slide over the preceding sheet 9, so that there is sufficient time to decelerate the preceding sheet 9 and so that overlapping takes place at the same time. The deflection device for the sheets (suction box 13) is located an adequate distance ahead of the clamping zones 17, 18 so that this takes place without problem. The preceding sheet 9 is decelerated, and the clamping has been released again, before the leading edge of the following sheet 9 reaches the clamping zone 17. As FIG. 6 shows, the following sheet 9 can then slide between the clamping elements 16, 17, while the clamping zones 17 are accelerated back to the higher infeed speed V1 before they come into contact with the sheet that has just entered and decelerate it.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for decelerating sheets that are to be placed on a stack, the device comprising:

rotatably drivable clamping elements, each having an axis of rotation, that are arranged across a width of the device on at least one side of a transport plane of the sheets, and that have clamping zones that extend into an infeed plane of the sheets part of the time during rotation, the clamping elements being configured to be connected to a variable rotary drive, the clamping elements have clamping zones shaped as annular segments on a portion of their circumference;

a rotating counter-element configured to be arranged on an opposite side of the transport plane of the sheets such that a sheet is clamped between the clamping zones and the counter-element; and a deflection device via which trailing edges of the sheets are deflected downward out of the infeed plane, the deflection device being located a distance ahead of the clamping elements in the direction of sheet travel, wherein the axes of rotation of the clamping elements are movable toward and away from the deflection device; and wherein the deflection device is a suction box that is switchable in a pulsed manner and has suction openings on the upper side.

2. The device according to claim 1, wherein the spacing between the clamping elements and the deflection device is at least 100 mm.

3. The device according to claim 1, wherein a three-phase synchronous servo motor comprises the variable drive for the clamping elements and/or the counter-element.

4. The device according to claim 3, wherein the three-phase synchronous servo motor has a ratio of length to diameter greater than 4.

5. The device according to claim 1, wherein the clamping zones are in the shape of annular segments and are fastened to an outside of a hollow shaft.

6. The device according to claim 5, wherein the hollow shaft comprises a carbon-fiber-reinforced plastic tube with an outer diameter of at least 100 mm.

7. The device according to claim 5, wherein the clamping zones are made of a volume-compressible foamed plastic material and have a radial thickness of 10 mm-30 mm.

8. The device according to claim 5, wherein the clamping zones have an outer diameter in the form of a circular arc, wherein the circumferential angle of the clamping zones on the hollow shaft is between 50° and 90°.

9. The device according to claim 5, wherein the counter-element is a rotatable hollow shaft with clamping zones in the shape of annular segments and connected to a variable rotary drive.

10. A machine for sheet cutting material webs, the machine comprising:

a sheet cutting device containing two cutter drums equipped with cross cutting knives; and a deceleration and overlapping device by which the sheets produced by sheet cutting are accepted and decelerated and wherein a cascade is formed, the deceleration and overlapping device comprising:

rotatably drivable clamping elements, each having an axis of rotation, that are arranged across a width of the device on at least one side of a transport plane of the sheets, and that have clamping zones that extend into an infeed plane of the sheets part of the time during rotation, the clamping elements being configured to be connected to a variable rotary drive, the clamping elements have clamping zones shaped as annular segments on a portion of their circumference;

a rotating counter-element configured to be arranged on an opposite side of the transport plane of the sheets such that a sheet is clamped between the clamping zones and the counter-element; and a deflection device via which trailing edges of the sheets are deflected downward out of the infeed plane, the deflection device being located a distance ahead of the clamping elements in the direction of sheet travel, wherein the axes of rotation of the clamping elements are movable toward and away from the deflection device; and wherein the deflection device is a suction box that is switchable in a pulsed manner and has suction openings on the upper side.

11. The device according to claim 1, wherein the sheets are paper or cardboard sheets.

12. The device according to claim 10, wherein the spacing between the counter-element and the deflection device is adjustable.

13. The device according to claim 1, wherein the spacing between the counter-element and the deflection device is adjustable.

14. The device according to claim 10, including a controller for controlling the suction box to switch on the suction box when a trailing edge of the sheet is located above the suction box.

* * * * *